US006638565B2

(12) United States Patent
Yamaguchi

(10) Patent No.: US 6,638,565 B2
(45) Date of Patent: Oct. 28, 2003

(54) COATING METHOD AND APPARATUS UTILIZING CONTROLLED ELECTROSTATIC CHARGE

(75) Inventor: Masato Yamaguchi, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/987,593

(22) Filed: Nov. 15, 2001

(65) Prior Publication Data

US 2002/0090447 A1 Jul. 11, 2002

(30) Foreign Application Priority Data

Nov. 15, 2000 (JP) ..... 2000-348112

(51) Int. Cl.[7] ..... B05D 1/38

(52) U.S. Cl. ..... 427/8; 427/458; 427/470; 427/471; 427/402; 427/420

(58) Field of Search ..... 427/8, 458, 470, 427/471, 402, 420

(56) References Cited

U.S. PATENT DOCUMENTS 4,835,004 A * 5/1989 Kawanishi ..... 427/458
5,424,174 A * 6/1995 Motokazu et al. ..... 430/350
6,027,871 A * 2/2000 Katoh ..... 430/619

* cited by examiner

*Primary Examiner*—Katherine A. Bareford
(74) *Attorney, Agent, or Firm*—Young & Thompson

(57) ABSTRACT

A coating method and coating apparatus with which layer surface defects caused by foreign matter such as dust particles and the like can be greatly reduced. The method and apparatus are characterized in that an static reducing device which reduces static charge on a support is provided. Before a coating solution for an emulsion layer is applied to the support web by a coating device, the static charge level of the support is reduced to 1 kV or less by a static eliminator. Thus, layer surface defects at a coated layer formed by coating are decreased.

9 Claims, 1 Drawing Sheet

COATING METHOD AND APPARATUS UTILIZING CONTROLLED ELECTROSTATIC CHARGE

BACKGROUND OF THE INVENTION

1. Field of the Invention

The present invention relates to a coating method and apparatus, and more specifically to a method and apparatus for eliminating static charge from a support when a coating solution for forming an emulsion layer of a heat development-type photosensitive material is to be applied onto the support.

2. Description of the Related Art

In recent years, in the fields of films for medical diagnosis and photographic films for plate-making, it has been strongly desired, from the standpoints of environmental protection and space-saving, to reduce the volume of processing waste fluids. Thus, there is a need for technologies relating to thermally developable photosensitive materials (heat development-type photosensitive materials), as films for medical diagnosis or photographic films for plate-making which can be efficiently exposed by a laser image setter or a laser imager to form clear black images having high resolution and sharpness. These heat development-type photosensitive materials are advantageous in providing customers with a thermal processing system that does not need liquid-type processing solutions, and which is simple and not harmful to the environment.

Photosensitive materials can be roughly divided into two types: silver halide photographic photosensitive materials in which gelatin-based binders are used and heat development-type photosensitive materials, in which polymer latex-based binders such as SBR (styrene/butadiene copolymer) are used. For both types of photosensitive material, a coating solution for a silver halide photographic photosensitive material or a coating solution for a heat development-type photosensitive material is applied onto a support web which is being continuously moved.

However, unlike silver halide photographic photosensitive materials, in the case of producing a heat development-type photosensitive material, there is a tendency, depending on subbing layers, for levels of electrostatic charge on the support to increase. Consequently, foreign matter such as dust particles tends to be easily attracted and adhered onto the support by static before the coating solution is applied. Further, because, unlike the gelatins used as binders for silver halide photographic photosensitive materials, the polymer latexes used as binders in heat development-type photosensitive materials cannot set (gelate), when the aforementioned foreign matter adheres thereto, layer surface defects in the coating layer tend to become noticeable even if the foreign particles are small. Thus, heat development-type photosensitive materials have a drawback in that the surface of the coated layer is susceptible to foreign matter causing layer surface defects when at least a coating solution for forming an emulsion layer is applied onto the support.

As well as heat development-type photosensitive materials frequently exhibiting such layer surface defects due to large amounts of static electricity on supports as described above, silver halide photographic photosensitive materials also suffer such layer surface defects if amounts of static charge on supports during production are high.

SUMMARY OF THE INVENTION

The present invention has been accomplished in view of the above-described circumstances. It is an object of the present invention to provide a coating method and apparatus to greatly reduce layer surface defects, which are caused by adhesion of foreign matter such as dust particles and the like to a coated layer formed by application of a coating solution onto a support.

In order to achieve the above object, the method according to the present invention is characterized in that, while at least a coating solution for an emulsion layer is being applied onto a continuously moving support web, static charge of the support is reduced to a level of at most 1 kV shortly before the coating solution for the emulsion layer is applied to the support web.

Also in order to achieve the above object, the apparatus according to the present invention is characterized in that, while at least a coating solution for an emulsion layer is being applied to a continuously moving support web, a static reducing device, which reduces the level of static charge on the support before application of the coating solution for the emulsion layer, is provided.

In accordance with the present invention, layer surface defects resulting from adhesion of foreign matter, such as dust, can be prevented from occurring, because the static charge level of a continuously moving support is made to be not more than 1 kV just before a coating solution is applied for forming at least an emulsion layer.

DESCRIPTION OF THE PREFERRED EMBODIMENTS

Figure 1:
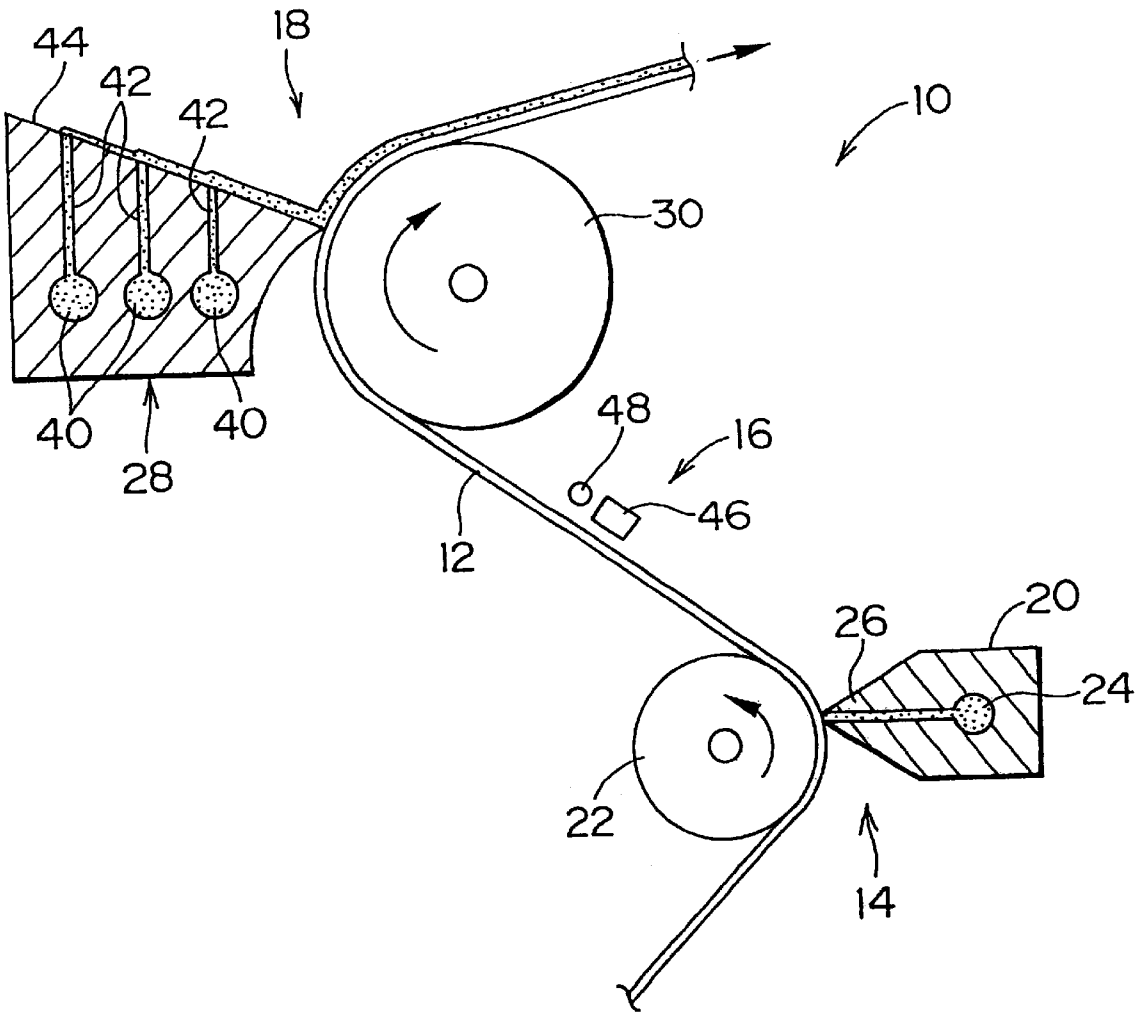
FIG. 1 is a structural diagram of a coating apparatus according to the present invention.

Referring to the accompanying drawing, a preferred embodiment of a coating method and apparatus according to the present invention is described in detail below.

In FIG. 1, numeral 10 denotes the coating apparatus, 12 denotes a support, 14 denotes a first coating device, 16 denotes a static reducing device, 18 denotes a second coating device, 20 denotes am extrusion-type coating hopper, 22 denotes a back-up roller, 28 denotes a slide-bead-type coating hopper, 30 denotes a back-up roller, 46 denotes a static eliminator, and 48 denotes a static charge measurement device.

As shown in FIG. 1, a coating apparatus 10 is principally structured by, in this order from an upstream side of a traveling path of the support 12, a first coating device 14, which applies a coating solution for a back layer to a reverse face (hereinafter referred to as "back face") of the support 12, which is opposed to a face onto which an emulsion layer coating solution is applied (hereinafter referred to as "front face"), a static reducing device 16 which reduces static charge of the support 12, and a second coating device 18, which applies the emulsion layer coating solution.

The first coating device 14 is principally structured of an extrusion-type coating hopper 20 and a back-up roller 22. A back surface coating solution, which is supplied to a pocket portion 24 of the coating hopper 20, flows through a slit 26, is ejected from a distal end of the slit 26, and is ejected onto the continuously moving support 12, which is wound round the back-up roller 22. Thereby, the back layer coating solution is applied onto the back face of the support 12.

The second coating device 18 is structured by a slide-bead-type coating hopper 28 and a back-up roller 30. Coating solution, which is supplied to a manifold 40, is pushed out through a slit 42 onto a downward-sloped sliding surface 44 and flows down. A bead (a pool of coating solution) is formed at a gap between a distal edge of the sliding surface 44 and the surface of the continuously moving support 12, which is wound round the back-up roller 30. The coating solution is applied via the bead to the support 12. The coating hopper 28 has a plurality of the manifold 40. Coating solutions for adjacent emulsion layers on the front face of the support 12, a coating solution for a protective layer to protect the emulsion layers, and the like are supplied to corresponding ones of the manifolds 40, and these coating solutions can be simultaneously applied onto the support 12 to form multiple layers. An emulsion layer coating solution for producing a heat development-type photosensitive material has a composition containing, for example, an organic silver salt, a reducing agent for silver ions, a polymer latex, and a photosensitive silver halide. In addition, an undercoat is formed on the front face of the support 12 beforehand, to improve adhesion of the emulsion layer to the support 12.

Because, in the process of producing a heat development-type photosensitive material, the support 12 is undercoated, which is different from the process of producing a silver halide photographic photosensitive material, the level of electrostatic charge on the support 12 tends to increase. Thus, when the emulsion layer coating solution is applied, layer surface defects of the coated layer are likely to occur because of adherence of foreign matter such as dust and the like, which is caused by the high level of static charge.

The present inventor analyzed the foreign matter that causes layer surface defects, and discovered that most thereof was foreign matter such as dust particles and the like within the production process. The inventor also discovered that reducing static charge of the support 12, particularly, reducing the static charge level to 1 kV or less just prior to application of an emulsion layer coating solution, can pre-emptively prevent layer surface defects. Based on this discovery, the coating apparatus 10 according to the present invention is provided with the static reducing device 16, to reduce the static charge on the support 12 shortly before application of the emulsion layer coating solution by the second coating device 18.

The static reducing device 16 is structured primarily of the static eliminator 46 and the static charge measurement device 48. The static eliminator 46 may be disposed anywhere between a feeding apparatus of the support 12 (not shown) and the second coating device, provided that position enables static elimination of the support 12 at most 20 seconds before the emulsion layer coating solution is applied. The resulting charge level after the static eliminator 46 has reduced the static is measured by the static charge measurement device 48. Here, static elimination is carried out such that the static charge of the support 12 is at 1 kV or less. The static charge of the support 12 after static elimination should be below 1 kV, more preferably at or below 700 V, and particularly preferably at or below 500 V.

It is preferable to reduce the static charge level after the back layer has been formed on the back face of the support 12. Because static charge on the support 12 is preliminarily reduced by application of the back layer, the static charge level of the support 12 can be more readily lowered to below 1 kV by static elimination of the static eliminator 46. Accordingly, the static eliminator 46 may be more preferably placed at a position between the first coating device 14 and the second coating device 18.

As the static charge measurement device 48, for example, a model 340B manufactured by Trek Inc., a STATIRON M-2 manufactured by Shishido Electrostatic, Ltd., or the like can be used. As the static eliminator 46, for example, an ion discharge-type static eliminator such as an elimino-type static eliminator 46, a corona discharge-type static eliminator 46 or a self-discharge-type static eliminator 46 can be used, among which the elimino-type is particularly preferred. As the elimino-type static eliminator 46, an SJ-B manufactured by Keyence Corporation, an ELIMINOSTAT manufactured by Shishido Electrostatic, Ltd., or the like can be used. Ion discharge-type, corona discharge-type and self-discharge-type static eliminators 46 may be employed in combination.

By using the coating apparatus 10 having the above-described structure, the static charge level of the moving support 12 can be lowered to 1 kV or less just before the emulsion layer coating solution is applied by the second coating device 18 and, as a consequence, foreign matter such as dust particles and the like is less likely to adhere to the support 12 during the production of the photosensitive material. Accordingly, even in a case where the support 12 has a greater susceptibility to static charge buildup because of an undercoat and, in addition, a binder which cannot set (gelate) such as a polymer latex is used in applying an emulsion layer coating solution for a heat development-type photosensitive material, layer surface defects caused by foreign matter such as dust particles and the like can be prevented. The present invention is particularly effective in cases where a support is more likely to attract dust particles when the static charge level is high, such as cases where the support 12 runs near a floor.

The present embodiment has been explained with the extrusion-type coating hopper 20 serving as the first coating device 14 and the slide-bead-type coating hopper 28 serving as the second coating device 18. However, the present invention is not limited to these, and other coating devices such as a curtain-type coating device may be employed. Also, an example of producing a heat development-type photosensitive material has been described in the present embodiment but, the present invention is not limited to heat development-type photosensitive materials. The present invention may be applied to any case in which layer surface defects occur due to foreign matter because of high static charge buildup on a support 12.

Description will now be made in detail of preferred forms of heat development-type photosensitive materials for embodying the present invention.

The organic silver salt usable in the present invention is a silver salt which is relatively stable to light, and forms a silver image when heated to a temperature of 80° C. or higher in the presence of a photocatalyst formed by irradiating with light (e.g., a latent image formed by a photosensitive silver halide) and a reducing agent. The organic silver salt may be any organic substance that contains a source capable of reducing a silver ion. Such non-photosensitive organic silver salts are described in paragraphs 0048 to 0049 of Japanese Patent Application Laid-Open No. 62899/1998, page 18, line 24 to page 19, line 37 of European Patent Laid-Open No. 0803764A1, European Patent Laid-Open No. 0962812A1, Japanese Patent Application Laid-Open Nos. 349591/1999, 7683/2000 and 72711/2000, etc. Preferred is a silver salt of an organic acid, particularly of a long-chain aliphatic carboxylic acid (having 10 to 30, preferably 15 to 28, carbon atoms). Preferred examples of such organic silver salts include silver behenate, silver arachidate, silver stearate, silver oleate, silver laurate, silver caproate, silver myristate, silver palmitate and mixtures thereof. Among these organic silver salts, an organic acid silver salt containing 75 mol % or more of silver behenate is preferably used in the present invention.

The shape of particles of an organic silver salt usable in the present invention is not particularly limited, and may be a needle, rod, plate or flake shape.

Preferably, a flaky organic silver salt is used in the present invention. Herein, flaky organic silver salts are defined as follows. If the salt is examined through an electron microscope and the shape of the particles is considered to be approximately a rectangular parallelepiped, its sides are named "a", "b" and "c" in an order beginning with the shortest dimension ("c" may be equal to "b"), and the values of the two shortest sides "a" and "b" are used to calculate "x" by the following equation:

$$x=b/a$$

The value "x" is calculated for about 200 particles and if their mean value, x (mean) $\geqq 1.5$, the particles are defined as flaky. Preferably, $30 \geqq x(\text{mean}) \geqq 1.5$, and more preferably $20 \geqq x(\text{mean}) \geqq 2.0$. Incidentally, the particles are needle-shaped if $1 \leqq x(\text{mean}) < 1.5$.

Side "a" of a flaky particle can be regarded as the thickness of a plate-shaped particle having a principal face defined by sides "b" and "c". The mean value of "a" is preferably from 0.01 to 0.23 $\mu$m, and more preferably from 0.1 to 0.20 $\mu$m. The mean value of c/b is preferably from 1 to 6, more preferably from 1.05 to 4, still more preferably from 1.1 to 3, and particularly preferably from 1.1 to 2.

The particle sizes of the organic silver salt preferably have a monodispersed size distribution. In the monodispersed distribution, the standard deviation of the length of the minor axis or major axis of the particles divided by a length value of the minor axis or major axis, respectively, is preferably not more than 100%, more preferably not more than 80%, and still more preferably not more than 50%. The shape of particles of the salt can be determined from an observed image of a dispersion thereof through a transmission electron microscope. The particle size distribution of the salt can alternatively be determined by employing the standard deviation of the volume weighted mean diameter of the particles, and is monodispersed if a percentage obtained by dividing the standard deviation of the volume weighted mean diameter by the volume weighted mean diameter (coefficient of variation) is not more than 100%, more preferably not more than 80%, and still more preferably not more than 50%. The particle size (volume weighted mean diameter) can be determined, for example, by applying laser light to the organic silver salt dispersed in a liquid and determining an autocorrelation function of the variation of fluctuation of scattered light with time.

Known methods can be employed to prepare and disperse an organic silver salt usable in the present invention. Reference can be made to, for example, Japanese Patent Application Laid-Open No. 62899/1998, European Patent Laid-Open No. 0803763A1, European Patent Laid-Open No. 0962812A1, Japanese Patent Application Laid-Open Nos. 349591/1999, 7683/2000 and 72711/2000, and Japanese Patent Application Nos. 348228/1999 to 348230/1999, 203413/1999, 90093/2000, 195621/2000, 191226/2000, 213813/2000, 214155/2000 and 191226/2000, etc.

A dispersion of the organic silver salt is preferably substantially free from any photosensitive silver salt, since fogging will be increased and its sensitivity will be greatly lowered. According to the present invention, an aqueous dispersion contains not more than 0.1 mol % of a photosensitive silver salt per 1 mol % of the organic silver salt, and photosensitive silver salt should not be added thereto.

According to the present invention, the photosensitive material can be prepared by mixing an aqueous dispersion of an organic silver salt with an aqueous dispersion of a photosensitive silver salt in a ratio depending on the purpose for which it will be used, preferably employing 1 to 30 mol %, more preferably 3 to 20 mol %, and still more preferably 5 to 15 mol % of the photosensitive silver salt relative to the organic silver salt. It is preferable, for obtaining a material having controlled photographic properties, to mix two or more kinds of aqueous dispersions of organic silver salts with two or more kinds of aqueous dispersions of photosensitive silver salts.

According to the present invention, the organic silver salt may be used in any amount as desired, but preferably in an amount containing 0.1 to 5 g/m$^2$, and more preferably 1 to 3 g/m$^2$ in terms of silver.

The heat development-type photosensitive material of the present invention preferably contains a reducing agent for the organic silver salt. The reducing agent (preferably an organic substance) may be any substance capable of reducing a silver ion to metallic silver. Such reducing agents are described in paragraphs 0043 to 0045 of Japanese Patent Application Laid-Open No. 65021/1999, and page 7, line 34 to page 18, line 12 of European Patent Laid-Open No. 0803764A1.

A hindered phenol-type or bisphenol-type reducing agent is preferably used as the reducing agent in the present invention.

The reducing agent is used preferably in an amount of 0.01 to 5.0 g/m$^2$, more preferably 0.1 to 3.0 g/m$^2$, and it is preferably used in an amount of 5 to 50 mol %, or more preferably 10 to 40 mol %, per mol of silver in the surface having an image forming layer. The reducing agent is preferably contained in the image forming layer.

The reducing agent may be added to a coating solution in any form, such as a solution, an emulsion or a dispersion of fine solid particles, and added to a photosensitive material.

According to a well-known method for emulsification, an emulsion is prepared mechanically by dissolving the reducing agent in an oil, such as dibutyl phthalate, tricresyl phosphate, glyceryl triacetate or diethyl phthalate, or in a co-solvent such as ethyl acetate or cyclohexanone.

A dispersion of fine solid particles can be prepared by dispersing a powder of the reducing agent in an appropriate solvent, such as water, using a ball mill, colloid mill, oscillating ball mill, sand mill, jet mill or roller mill, or ultrasonically. It is possible to use a protective colloid (e.g., polyvinyl alcohol), or a surface active agent (e.g., an anion surface active agent, such as sodium triisopropylnaphthalenesulfonate (a mixture of compounds each having an isopropyl substituent group at three different positions)). The aqueous dispersion may contain a preservative (e.g., sodium benzisothiazolinone).

The heat development-type photosensitive material of the present invention preferably contains, as a developing accelerator, a phenol derivative as represented by formula (A) shown in Japanese Patent Application No. 73951/1999.

The transparent support is preferably a polyester, particularly polyethylene terephthalate which has been heat-treated at a temperature of 130 to 185° C., so that the support may have a reduced residual internal distortion as a biaxially oriented film, which prevents any thermal shrinkage distortion from occurring during thermal developing process. A transparent support for a heat development-type photosensitive material to be used for medical diagnosis may or may not be colored with a blue dye (e.g., Dye-1 as described in Japanese Patent Application Laid-Open No. 240877/1996). It is preferable to employ a method of applying an undercoat of, e.g., a water-soluble polyester as described in Japanese Patent Application Laid-Open No. 84574/1999, a styrene-butadiene copolymer as described in Japanese Patent Application Laid-Open No. 186565/1998, or a vinylidene chloride copolymer as described in Japanese Patent Application Laid-Open No. 39684/2000, or paragraphs 0063 to 0080 of Japanese Patent Application No. 106881/1999. For an anti-static layer, or undercoat, it is possible to employ methods described in Japanese Patent Application Laid-Open Nos. 143430/1981, 143431/1981, 62646/1983 or 120519/1981, paragraphs 0040 to 0051 of Japanese Patent Application Laid-Open No. 84573/1999, U.S. Pat. No. 5,575,957, or paragraphs 0078 to 0084 of Japanese Patent Application Laid-Open No. 223898/1999.

The heat development-type photosensitive material is preferably of a mono-sheet type (a type which can form an image thereon without using another sheet such as an image-receiving material).

The heat development-type photosensitive material may further contain an antioxidant, stabilizer, plasticizer, ultraviolet absorber, and coating auxiliary. The various additives may be added to a photosensitive or non-photosensitive layer. In this connection, reference can be made to WO98/36322, EP803764A1, Japanese Patent Application Laid-Open Nos. 186567/1998 and 186568/1998, etc.

Any method of coating can be employed to produce the heat development-type photosensitive material according to the present invention. More specifically, any of various coating methods including extrusion coating, slide coating, curtain coating, dip coating, knife or flow coating, and extrusion coating using a hopper of the type described in U.S. Pat. No. 2,681,294 can be employed, preferably extrusion or slide coating as described on pages 399 to 536 of "LIQUID FILM COATING" by Stephen F. Kistler and Peter M. Schweizer (Chapman & Hall, 1997), and more preferably slide coating. Examples of the form of a slide coater used for slide coating are shown in FIG. 11b.1on page 427 thereof. If desired, it is also possible to form two or more coating layers simultaneously by employing a method as described on pages 399 to 536, ibid., in U.S. Pat. No. 2,761,791 or in British Patent No. 837,095.

The coating solution for forming a layer containing an organic silver salt according to the present invention is preferably a thixotropic fluid. In this connection, reference is made to Japanese Patent Application Laid-Open No. 52509/1999. The solution preferably has a viscosity of 400 to 100,000 mPa·s and more preferably 500 to 20,000 mPa·s at a shear rate of 0.1 $s^{-1}$, and a viscosity of 1 to 200 mPa·s and more preferably 5 to 80 mPa·s at a shear rate of 1000 $s^{-1}$.

EXAMPLES

The examples described below were carried out to evaluate how the time taken from static elimination of the support to coating of the emulsion layer coating solution on the support, and how the application or not of the back layer coating solution would affect layer surface defects of the coated layer.

A coating apparatus employed in the Examples was basically the apparatus shown in FIG. 1. The static charge measurement device was positioned just before the second coating device, and static charge levels of supports were measured directly before coating.

Coating liquid coated onto the support at the second coating device consisted of several kinds of coating solutions, including a coating solution for the emulsion layer. These solutions were simultaneously applied to form a multiple layer, at a coating speed (corresponding to a traveling rate of the support) of 100 m/min.

Example 1

In Example 1, an elimino-type static eliminator was provided 10 meters upstream of the second coating device (6 seconds between static elimination and coating), and a back layer coating solution was applied onto the back face of the support at the first coating device.

Example 2

Example 2 was the same as Example 1 except that the elimino-type static eliminator was provided 30 meters upstream of the second coating device (18 seconds from static elimination to coating).

Example 3

Example 3 was the same as Example 1 except that the elimino-type static eliminator was provided 5 meters upstream of the second coating device (3 seconds from static elimination to coating).

Comparative Example 1

Comparative Example 1 was the same as Example 1 except that the elimino-type static eliminator was provided 50 meters upstream of the second coating device (30 seconds from static elimination to coating).

Comparative Example 2

Comparative Example 2 was the same as Comparative Example 1 except that the back layer coating solution was not applied.

Table 1 gives results of evaluating layer surface defects on coated layers produced by the Examples and the Comparative Examples under the above-described conditions. Specimens of 10 m2 were sampled from the supports at a coated position of 1000 meters distant from the commencement of coating. To what extent layer surface defects caused by foreign matter had occurred at the coated layer surfaces of the sampled supports was evaluated. Here, the incidence of layer surface defects was determined by the number of layer surface defect spots of 2 mm or greater per 1 m2 of coated layer surface.

TABLE 1

| | Distance Upstream Of Static Eliminator From Coating (m) | Time Between Static Elimination and Coating (sec.) | Static Charge Of Support (V) | Back Layer? | Number Of Spots (per $m^2$) |
|---|---|---|---|---|---|
| Ex. 1 | 10 | 6 | 500 | Yes | 0.5 |
| Ex. 2 | 30 | 18 | 700 | Yes | 0.5 |
| Ex. 3 | 5 | 3 | 200 | Yes | 0.2 |
| Comp. Ex. 1 | 50 | 30 | 5000 | Yes | 3.4 |
| Comp. Ex. 2 | 50 | 30 | 10000 | No | Too many To count |

As can be seen from table 1, for Examples 1 to 3, in which back layer coating solutions were applied to the back faces of the support webs and static elimination was performed at most 20 seconds before the emulsion layer coating solution was applied, results were excellent in that in each case static charge of the support was kept to below 1 kV just before coating, and the spot count was no more than 0.5. In particular, in Example 3, in which the time from static elimination to coating was a brief 3 seconds, layer surface defects were almost indiscernible, the count being 0.2.

In contrast, in Comparative Example 1, in which the time from static elimination to coating was a lengthy 30 seconds, static charge of the support directly before coating, at 5000 V, was high and the spot number was 3.4, more than six times greater than for the results of the Examples.

In Comparative Example 2, without a back layer, results were extremely poor, with a high static charge level at the support of 10000 V just before coating and a very large number of spots. As is apparent from comparison of Comparative Examples 1 and 2, it is difficult to reduce the static charge when there is no back layer, and spots are numerous. This means that static charge can be effectively reduced by static elimination at a static eliminator after a back layer has been applied.

As explained above, the coating method and apparatus according to the present invention can remarkably decrease the incidence of layer surface defects caused by foreign matter such as dust particles and the like in a coated layer formed by coating.

Accordingly, the present invention is particularly effective in a case of applying a coating solution for an emulsion layer of a heat development-type photosensitive material, where a support is susceptible to high static charge buildup in the production process, and an unsettable (non-gelable) binder such as a polymer latex is used.

What is claimed is:

1. A method for coating at least a coating solution for an emulsion layer on a support, the method comprising the steps of:

moving the support continuously while applying a back layer coating solution to a first face of the support;

after applying the back layer coating solution, reducing a level of the electrostatic charge on the support material to no more than 1 kV; and within 20 seconds after reducing the level of the electrostatic charge, coating the coating solution for the emulsion layer onto a second face of the continuously moving support opposite the first face.

2. The method of claim 1, wherein the step of reducing the level of the electrostatic charge level of the continuously moving support to no more than 1 kV comprises the steps of:

measuring the static charge level of the support after applying the back layer coating solution and prior to applying the coating solution for the emulsion layer; and if the static charge level is greater than 1 kV, eliminating static such that the static charge level is at most 1 kV.

3. The method of claim 2, wherein the step of eliminating static comprises eliminating static such that the static charge level is at most 700 V.

4. The method of claim 2, wherein the step of eliminating static comprises eliminating static such that the static charge level is at most 500 V.

5. The method of claim 2, wherein the coating solution for the emulsion layer is coated for producing a heat development-type photosensitive material.

6. The method of claim 1, wherein the coating solution for the emulsion layer is coated for producing a heat development-type photosensitive material.

7. The method of claim 1, a time delay between reducing the level of the electrostatic charge and coating the coating solution for the emulsion layer onto the second face of the continuously moving support is no more than 18 seconds.

8. The method of claim 7, wherein the time delay is no more than six seconds.

9. The method of claim 7, wherein the time delay is no more than three seconds.

* * * * *